US010942476B2

(12) United States Patent
Ogura et al.

(10) Patent No.: US 10,942,476 B2
(45) Date of Patent: Mar. 9, 2021

(54) IMAGE FORMING APPARATUS WITH A PLURALITY OF INDIVIDUALLY-CONTROLLED HEAT GENERATING RESISTORS HAVING DIFFERENT TEMPERATURE COEFFICIENTS OF RESISTANCE

(71) Applicant: CANON KABUSHIKI KAISHA, Tokyo (JP)

(72) Inventors: Ryota Ogura, Numazu (JP); Yusuke Nakashima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/715,313

(22) Filed: Dec. 16, 2019

(65) Prior Publication Data

US 2020/0201214 A1 Jun. 25, 2020

(30) Foreign Application Priority Data

Dec. 19, 2018 (JP) ..... JP2018-237166

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
USPC ..... 399/69
See application file for complete search history.

(56) References Cited

U.S. PATENT DOCUMENTS

| | | | | |
|---|---|---|---|---|
| 10,303,095 | B2 * | 5/2019 | Takagi et al. | G03G 15/2039 |
| 10,416,595 | B2 | 9/2019 | Ogura et al. | |
| 10,503,103 | B2 | 12/2019 | Ogura | |
| 10,514,636 | B2 * | 12/2019 | Takagi | G03G 15/2039 |
| 10,656,573 | B2 * | 5/2020 | Aiba | G03G 15/2039 |
| 2019/0317434 | A1 | 10/2019 | Ogura et al. | |

FOREIGN PATENT DOCUMENTS

| | | | |
|---|---|---|---|
| JP | 06-019347 | A | 1/1994 |
| JP | 11-161087 | A | 6/1999 |
| JP | 2003-297533 | A | 10/2003 |
| JP | 2015-194713 | A | 11/2015 |
| JP | 2018-072374 | A | 5/2018 |

* cited by examiner

*Primary Examiner* — William J Royer
(74) *Attorney, Agent, or Firm* — Venable LLP

(57) ABSTRACT

In an image forming apparatus including an image heating portion that heats an image formed on a recording material using heat of a heater constituted of a substrate and a plurality of heat generating resistors disposed on the substrate, the plurality of heat generating resistors include (i) a first heat generating resistor that has a first temperature coefficient of resistance, and (ii) a second heat generating resistor that has a second temperature coefficient of resistance which is smaller than the first temperature coefficient of resistance, and heats a second heating region of which width in the longitudinal direction of the substrate is narrower than the first heating region which is heated by the first heat generating resistor, among the plurality of heating regions heated by the plurality of heat generating resistors.

7 Claims, 12 Drawing Sheets

| HB1 | HB2 | HB3 | HB4 | HB5 | HB6 | HB7 |
|---|---|---|---|---|---|---|
| α1 | α2 | α3 | α4 | α5 | α6 | α7 |
| 1300 | 500 | 500 | 500 | 500 | 500 | 1300 |

UNIT [ppm/℃]

| HB8 | HB9 | HB10 |
|---|---|---|
| α8 | α9 | α10 |
| −800 | −1200 | −800 |

UNIT [ppm/°C]

IMAGE FORMING APPARATUS WITH A PLURALITY OF INDIVIDUALLY-CONTROLLED HEAT GENERATING RESISTORS HAVING DIFFERENT TEMPERATURE COEFFICIENTS OF RESISTANCE

BACKGROUND OF THE INVENTION

Field of the Invention

The present invention relates to an image forming apparatus having an image heating apparatus for a heated material as an image fixing unit.

Description of the Related Art

As an image heating apparatus, which is installed in an image forming apparatus using an electrophotographic system, an electrostatic recording system or the like, an apparatus that includes a fixing film, a plate type heater which contacts the inner surface of the fixing film, and a roller which forms a nip portion with the heater via the fixing film, has been used. A plate type heater according to Japanese Patent Application Publication No. 2015-194713 includes heating block groups which are divided in the longitudinal direction of the heater, and configured so that a plurality of heating regions, which are disposed side by side in the longitudinal direction, can be selectively heated. In a heating element (heat generating resistor) constituting the heating block, the resistance value changes depending on the temperature of the heating element, as disclosed in Japanese Patent Application Publication No. 2015-194713 and Japanese Patent Application Publication No. H06-019347, that is, the resistance value has a temperature dependency characteristic. For each heating block, an individual power supply circuit is provided so as to control the temperature independently.

SUMMARY OF THE INVENTION

However, in the case of a plurality of heating blocks, as disclosed in Japanese Patent Application Publication No. 2015-194713, each of the heating blocks has an independent power supply circuit, hence if one of the power supply circuits fails, this heating block, out of the heating block group, may be continuously heated. In this case, a heating block of which width in the longitudinal direction is narrower has a higher thermal stress compared with a heating block of which width is wider.

It is an object of the present invention to provide a technique whereby in a heater which selectively heats a plurality of heating regions, damage to the heater when temperature is rising, can be prevented regardless the width of the individual heating regions.

To achieve the above object, an image forming apparatus of the present invention includes:

an image forming portion that forms an image on a recording material;

an image heating portion that includes a heater including a substrate and a plurality of heat generating resistors disposed on the substrate, and heats the image formed on the recording material using heat of the heater; and a control portion that individually controls a plurality of heating regions which are heated by the plurality of heat generating resistors, by individually controlling power to be supplied to the plurality of heat generating resistors, wherein the plurality of heat generating resistors include (i) a first heat generating resistor that has a first temperature coefficient of resistance, and (ii) a second heat generating resistor that has a second temperature coefficient of resistance which is smaller than the first temperature coefficient of resistance, and heats a second heating region of which width in the longitudinal direction of the substrate is narrower than a first heating region which is heated by the first heat generating resistor, among the plurality of heating regions.

According to the present invention, in a heater which selectively heats a plurality of heating regions, damage to the heater when temperature is rising can be prevented, regardless the width of the individual heating regions.

Further features of the present invention will become apparent from the following description of exemplary embodiments (with reference to the attached drawings).

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 1:
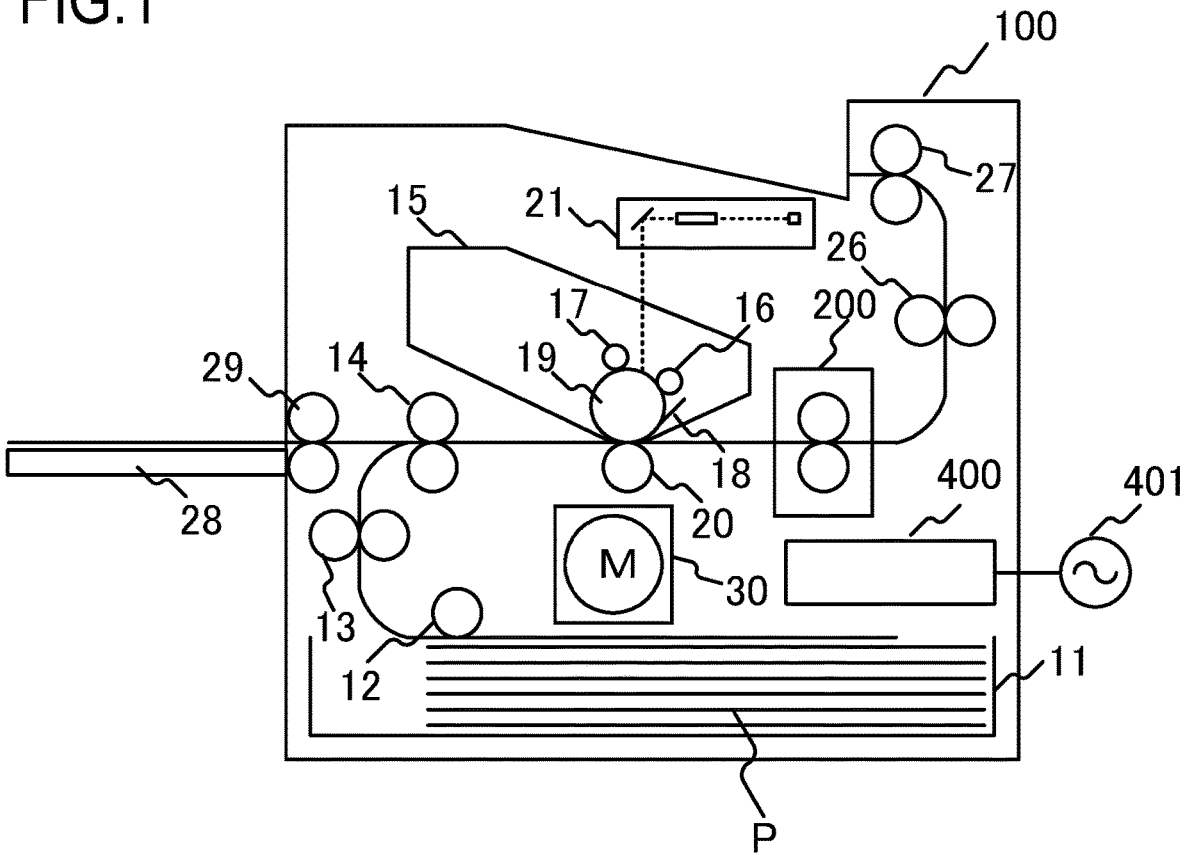
FIG. 1 is a cross-sectional view depicting an image forming apparatus.

FIG. 1 is a schematic cross-sectional view of an image forming apparatus 100 according to an embodiment of the present invention. The image forming apparatus 100 of this embodiment is a laser printer that forms an image on a recording material using an electrophotographic system. Image forming apparatuses to which the present invention can be applied are, for example, a copier and a printer that use an electrophotographic system or an electrostatic recording system. A case of applying the present invention to a laser printer will be described here. An image heating apparatus to which the present invention can be applied is, for example, a fixing unit installed in the above-mentioned image forming apparatus 100, or a glossing apparatus which improves the gloss value of a toner image by reheating the toner image fixed to the recording material.

Unless otherwise specified, "longer direction" in the following description is the longer direction of the heater (substrate), and is a direction orthogonal to the transporting direction of the recording material (the width direction of the unskewed recording material, the shorter direction of the unskewed recording material that is vertically transported). "Shorter direction" is a direction orthogonal to the "longer direction", and is a direction along the transporting direction of the recording material (the length direction of the unskewed recording material, the longer direction of the unskewed recording material that is vertically transported).

When a print signal is generated, a scanner unit 21 emits a laser light which is modulated in accordance with image information, and scans an electrophotographic photosensitive member (hereafter photosensitive member) 19, which is charged to a predetermined polarity by a charging roller 16. Thereby an electrostatic latent image is formed on the photosensitive member 19 (image bearing member). Toner is supplied from a developing roller 17 to this electrostatic latent image, and a toner image (developer image) in accordance with the image information is formed on the photosensitive member 19. The recording paper (recording material) P loaded in a paper feeding cassette 11 is fed one by one by a pickup roller 12, and is transported to a resist roller pair 14 by a transporting roller pair 13. Then the recording paper P is transported from the resist roller pair 14 to a transfer position so as to match the timing when the toner image on the photosensitive member 19 reaches the transfer position where the photosensitive member 19 meets a transfer roller 20 (transfer member). While the recording paper P passes through the transfer position, the toner image on the photosensitive member 19 is transferred to the recording paper P. Then the recording paper P is heated by a fixing apparatus (image heating apparatus) 200, which is a fixing portion (image heating portion), whereby the toner image is thermally fixed to the recording paper P. The recording paper P, which bears the fixed toner image, is discharged to a paper delivery tray, which is disposed in an upper portion of the image forming apparatus 100, by a transporting roller pair 26 and 27. The photosensitive member 19 is cleaned by a cleaner 18. The image forming apparatus 100 according to this embodiment includes a paper feeding tray (manual feeding tray) 28 which includes a pair of recording paper regulating plates of which width can be adjusted depending on the size of the recording paper P. The paper feeding tray 28 is disposed to support recording paper P which is not a standard size, and is fed using a pickup roller pair 29. A motor 30 is a power source to drive the fixing apparatus 200 and the like. Power is supplied to the fixing apparatus 200 via a control circuit (control portion) 400 connected to a commercial AC power supply 401.

The photosensitive member 19, the charging roller 16, the scanner unit 21, the developing roller 17 and the transfer roller 20 constitute an image forming portion that forms an unfixed image on the recording paper P. In this embodiment, the photosensitive member 19, the charging roller 16, the developing roller 17, the cleaner 18 and the like are integrated as a process cartridge 15, so as to be integrally attached to/removed from the main body of the image forming apparatus 100.

Figure 2:
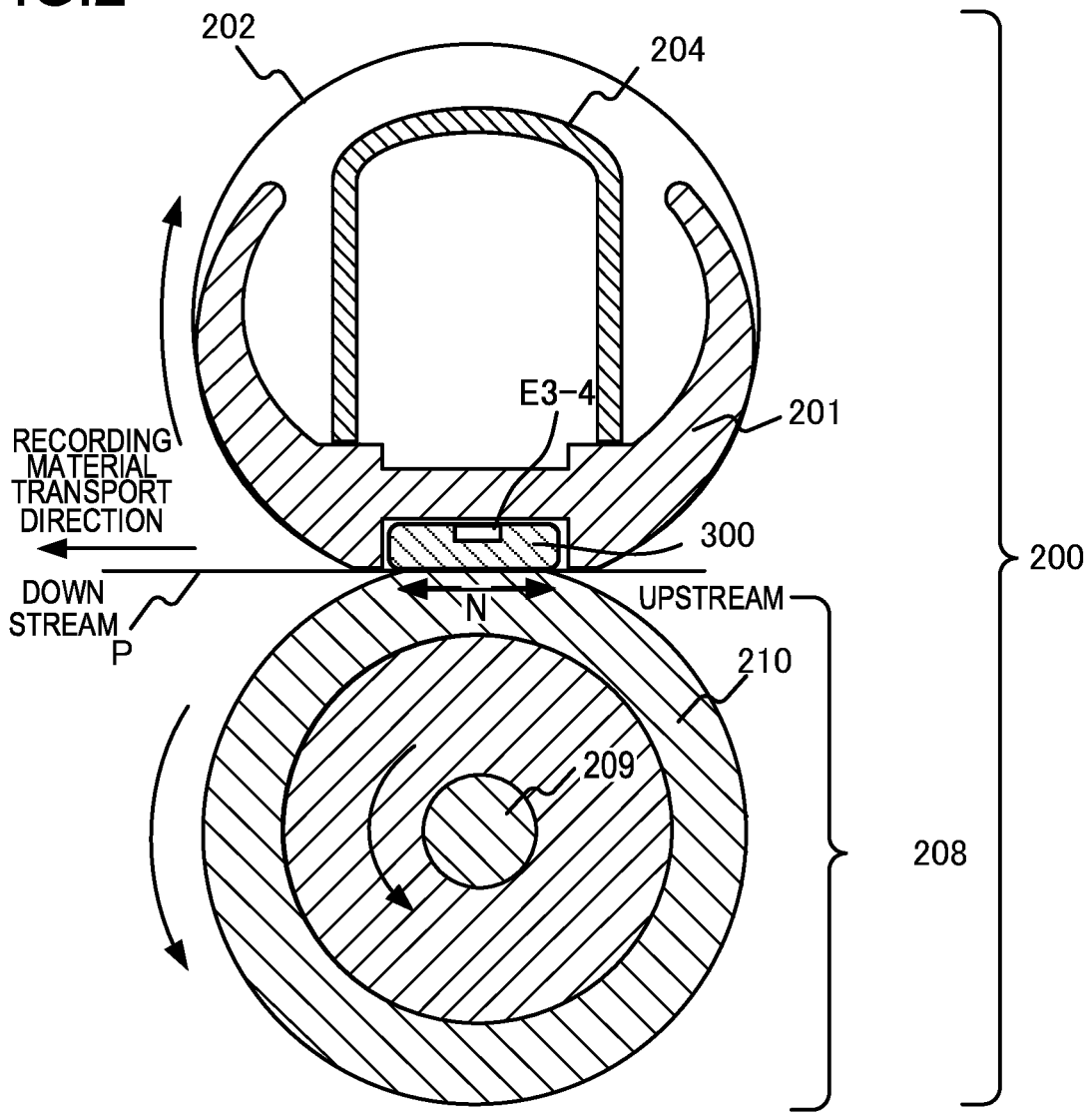
FIG. 2 is a cross-sectional view depicting an image heating apparatus.

FIG. 2 is a cross-sectional view of the fixing apparatus 200 according to this embodiment. The fixing apparatus 200 includes a fixing film (hereafter "film") 202, a heater 300 which contacts the inner surface of the film 202, and a pressure roller (nip portion forming member) 208 which forms a fixing nip portion N with the heater 300 via the film 202. The film 202 is a cylindrical heat resistant film which is also called an endless belt or endless film, and a material of the base layer is a heat resistant resin (e.g. polyimide) or a metal (e.g. stainless steel). An elastic layer (e.g. heat resistant rubber) may be disposed on the surface layer of the film 202. The pressure roller 208 includes a core metal 209 made of iron, aluminum or the like, and an elastic layer 210 made of silicon rubber or the like. The heater 300 is held by a holding member 201 made of a heat resistant resin. The holding member 201 also has a guide function which guides the rotation of the film 202. A stay 204, which is made of metal, applies pressure to the holding member 201 using a spring (not illustrated). The pressure roller 208 rotates in the arrow direction by the power received from the motor 30 (FIG. 1). By the rotation of the pressure roller 208, the film 202 is also rotated. The recording paper P bearing an unfixed toner image is heated and fixed while being held and transported by the fixing nip portion N.

The heater 300 is a heat source having the later mentioned heat generating resistors, and includes an electrode E3-4 to feed power. In the holding member 201, a hole is opened at the location of the electrode E3-4, so that the power feeding path is connected to the electrode E3-4 via the hole.

Figure 3A:
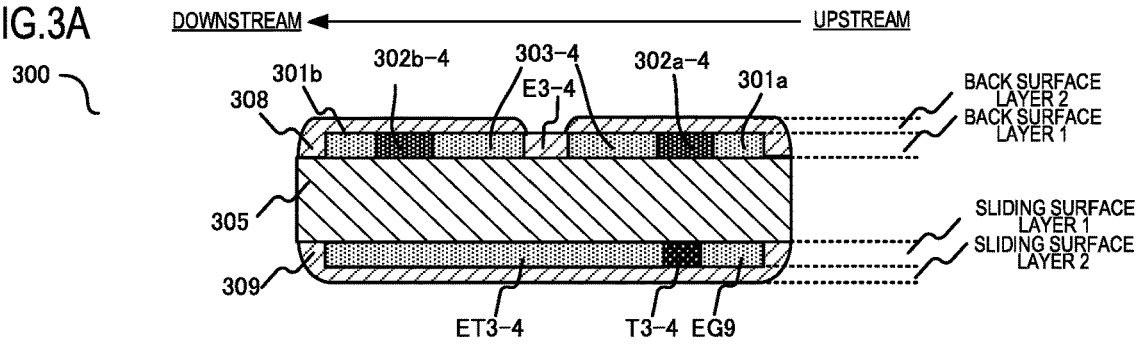
FIG. 3A and FIG. 3B are diagrams depicting a configuration of a heater according to Embodiment 1.
Figure 3B:
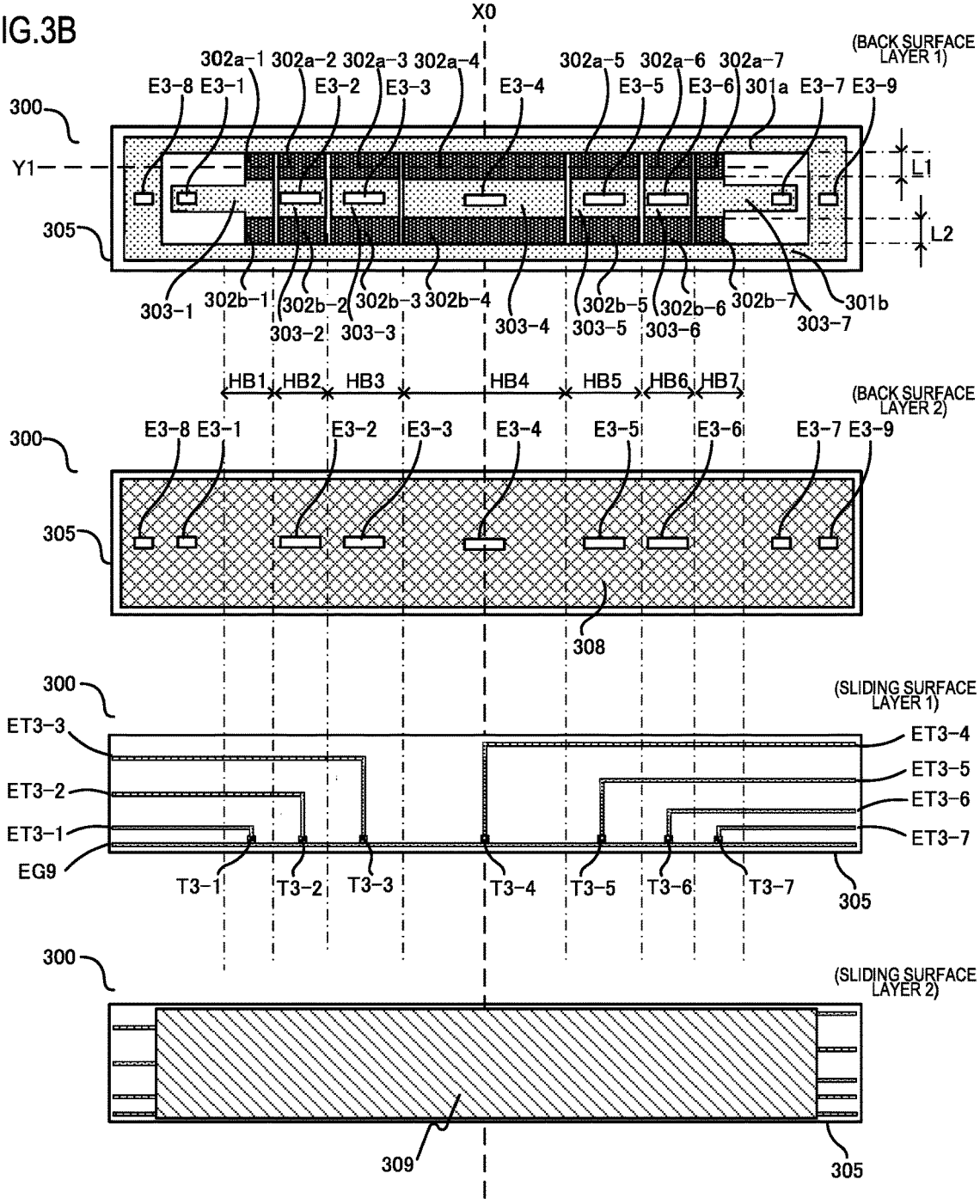

The configuration of the heater 300 and the holding member 201 according to this embodiment will be described with reference to FIG. 3A and FIG. 3B. FIG. 3A is a cross-sectional view of the heater 300 sectioned in the shorter direction (direction orthogonal to the longer direction), and is a cross-sectional view around a transport reference position X0 indicated in FIG. 3B. FIG. 3B is a plan view depicting a configuration of each layer of the heater 300. The transport reference position X0 of the recording material P in the image forming apparatus 100 of this embodiment is at the center, and the recording material P is transported such that a center line in the direction orthogonal to the transporting direction (that is, the width direction) of the recording material P moves along the transport reference position X0.

As illustrated in FIG. 3A, the heater 300 includes conductors 301*a* and 301*b* and a conductor 303-4 on a substrate 305 on a back surface layer 1. The conductor 301*a* is disposed on the upstream side in the transporting direction of the recording material P, and the conductor 301*b* is disposed on the downstream side thereof. Further, in the heater 300, heating elements 302 (302*a*-1 to 302*a*-7, 302*b*-1 to 302*b*-7), which are heat generating resistors that are heated by the supplied power, are disposed between the conductors 301*a*, 301*b* and the conductor 303-4 on the substrate 305. The heating elements 302 are separated into the heating element 302*a*-4 (302*a*-1 to 302*a*-7) disposed on the upstream side of the recording material P and the heating element 302*b*-4 (302*b*-1 to 302*b*-7) disposed on the downstream side of the recording material P. Further, the electrode E3-4 (E3-1 to E3-7, E3-8 and E3-9) are disposed to feed power. On a back surface layer 2, a protective glass 308 having an insulating property covers a region on the back surface layer 1, except for the electrode E3-4 (E3-1 to E3-7, and E3-8 and E3-9).

On a sliding surface layer 1 on a sliding surface (surface on the side of contacting the fixing film) of the heater 300, a thermistor T3-4 (T3-1 to T3-7) printed on the substrate 305 exists as a temperature detection unit. This thermistor has a negative resistance temperature characteristic, and the resistance value changes depending on the temperature. A glass 309 covers thereon as a sliding surface layer 2.

As FIG. 3B illustrates, seven sets of heating blocks (heating region HB1 to HB7), constituted of a conductor 301, a conductor 303, a heating element 302 and an electrode E3, are disposed on the back surface layer 1 of the heater 300 along the longer direction of the heater 300 (substrate 305). In the following description, in order to indicate the correspondence with the seven heating blocks HB1 to HB7, a member corresponding to each heating block is denoted with a reference sign to which the corresponding heating block number is attached, such as heating elements 302*a*-1 to 302*a*-7. This is the same for the heating element 302*b*, the conductors 301*a* and 301*b*, the conductor 303 (i.e., members 303-1, 303-2, 303-3, 303-4, 303-5, 303-6, and 303-7 correspond to respective heating blocks HB1 to HB7) and the electrode E3.

The heating elements 302 in each heating block have a same resistivity per unit length in the longitudinal direction at a predetermined temperature (e.g. normal temperature), and have a same heating value per unit length. The seven heating regions arranged in the longitudinal direction are individually heated by the seven heating blocks HB1 to HB7 respectively. As illustrated here, in the heating blocks HB1 to HB7, HB4 has the longest region in the longitudinal direction (heats the widest heating region in the longitudinal direction), and HB1 and HB7 have the shortest regions (heats the narrowest heating region in the longitudinal direction). The electrodes E3-8 and E3-9 are hetero-polar electrodes for the heater electrodes E3-1 to E3-7, and are disposed at each end of the heater 300.

The surface protective layer (protective glass) 308 of the back surface layer 2 of the heater 300 is formed such that the heater electrodes E3-1 to E3-9 are exposed.

On the sliding surface layer 1, which is the opposite side surface of the back surface layers 1 and 2 of the substrate 305, on the other hand, the thermistors T3-1 to T3-7 are disposed as temperature detection elements to detect the temperature of each heating block of the heater 300, and are used for temperature control of each heating block. One end of each thermistor T3-1 to T3-7 is connected to each conductor ET3-1 to ET3-7 for detecting the resistance value of the thermistor respectively, and the other end thereof is commonly connected to the conductor EG9.

On the sliding surface layer 2 of the heater 300, the surface protective layer (glass) 309 is formed by coating glass having slidability, except on both ends of the heater 300, so as to form an electric contact for each conductor of the sliding surface layer 1.

Figure 4:
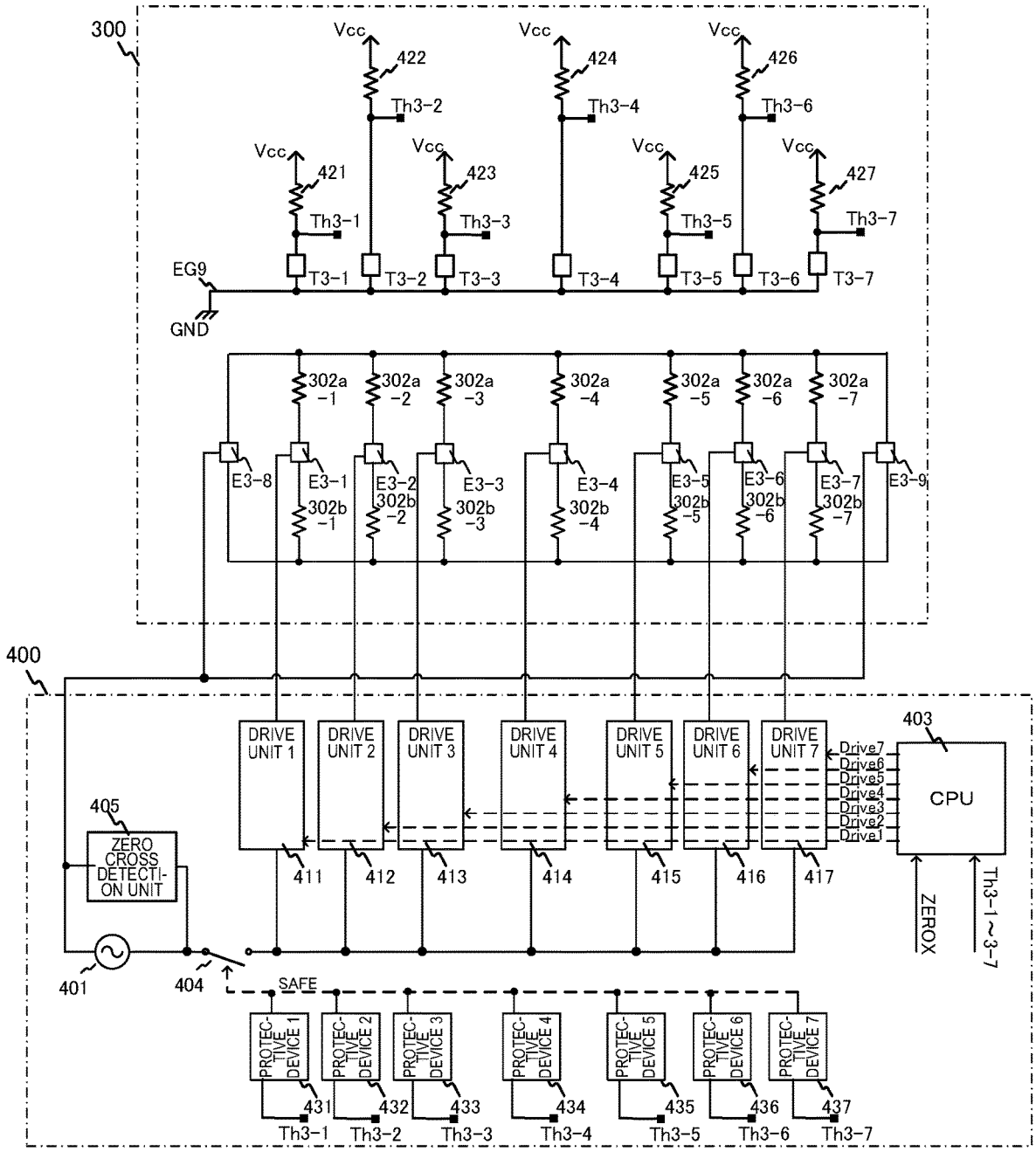
FIG. 4 is a circuit connection diagram according to Embodiment 1.

FIG. 4 is a block diagram depicting a control circuit 400 and the electric connection according to this embodiment. A commercial AC power supply 401 is connected to the image forming apparatus 100. Vcc is generated by an AC/DC convertor (not illustrated) connected to the AC power supply 401, and is used for detection of the thermistors T3-1 to T3-7. A zero cross detection unit 405 generates a ZEROX signal which controls timing for intermediate potential of the AC power supply, and inputs the ZEROX signal to a CPU 403. Thermistor signals Th3-1 to Th3-7, which are generated by dividing the voltage in the thermistors T3-1 to T3-7 and resistors 421 to 427 respectively, are also inputted to the CPU 403. Based on the thermistor signals Th3-1 to Th3-7 and the ZEROX signal, the CPU 403 generates drive signals Drivel to Drivel and controls drive units 411 to 417. The drive circuits are individually connected to the drive units 411 to 417 so as to drive the heating blocks HB1 to HB7 independently. The drive units 411 to 417 also control the temperatures of the heating elements 302*a* and 302*b* of each heating block of the heater 300 by turning the current path ON/OFF using such an element as a triac. Protective devices 431 to 437 are protective units that monitor temperatures to protect against reaching an abnormal temperature, based on the thermistor signals Th3-1 to Th3-7. If temperature reaches an abnormal temperature, a SAFE signal is activated, and a relay 404 is forcibly set to the non-conducting state, so as to stop feeding power to the heater 300 (stop supplying power to the heat generating resistor).

In this embodiment, the drive unit is provided to each of the heating blocks HB1 to HB7 individually, but one drive unit may be connected to and drive a plurality of heating blocks. For example, the heating block HB2 and the heating block HB6, which are disposed linearly symmetrical with respect to the transport reference position X0, may be connected to one driving unit.

Figure 5A:
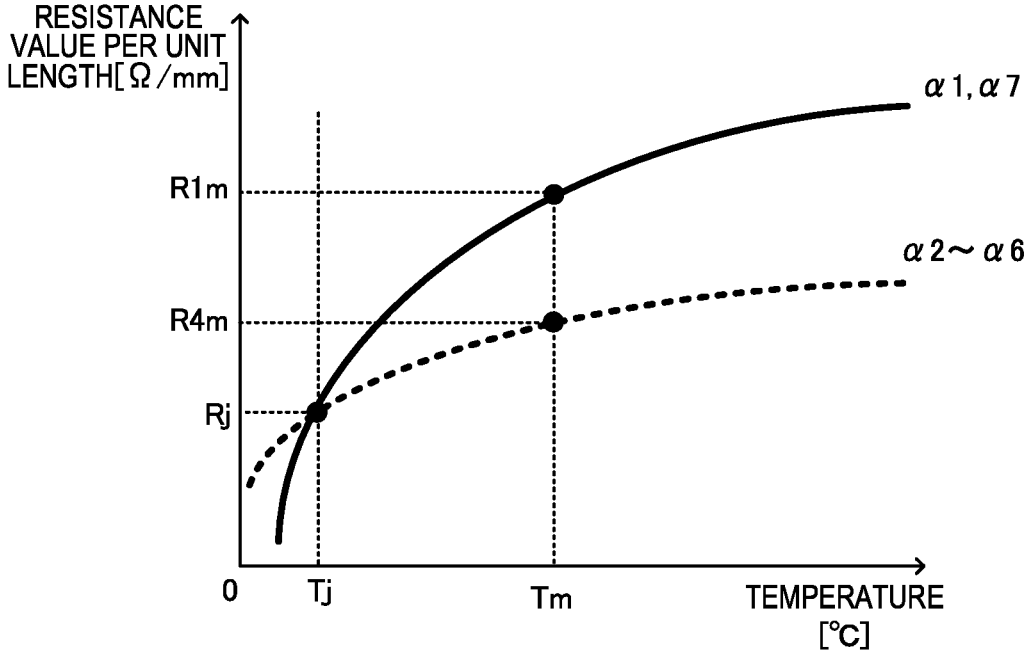
FIG. 5A and FIG. 5B are diagrams depicting the temperature characteristic of the heating elements and distribution of the temperature coefficient of resistances according to Embodiment 1.
Figure 5B:
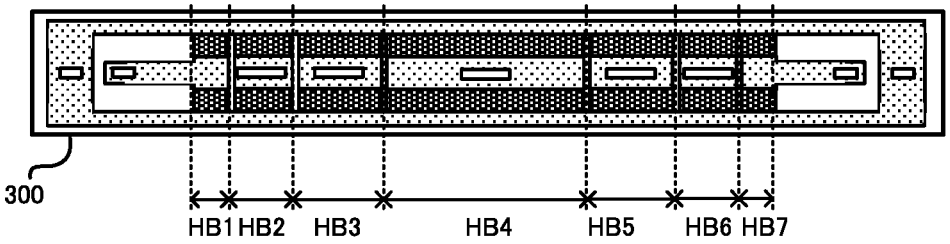

FIG. 5A and FIG. 5B are diagrams depicting the resistance temperature characteristic of the heating elements (heat generating resistors) 302*a* and 302*b* of the heater 300 according to this embodiment. FIG. 5A is a graph depicting the temperature and the resistance value per unit length of the heating element in the length direction, and FIG. 5B indicates the distribution of the resistance temperature characteristic of the heater 300 of this embodiment. The heating elements 302*a* and 302*b* of this embodiment have a positive resistance temperature characteristic, hence the resistance values of the heating elements 302*a* and 302*b* increase as the temperature rises (from normal temperature Tj to Tm). A coefficient to indicate this temperature rise (ratio of the change of the resistance value with respect to the change of the temperature) is a temperature coefficient of resistance $\alpha$, which is determined by the material characteristic of the heating element. Typical examples of the material of the heating element are silver palladium (Ag/Pd) and ruthenium oxide ($RuO_2$), and the temperature coefficient of resistance can be controlled by adjusting the proportion of these materials.

In this embodiment, when the temperature coefficient of resistances of the heating blocks HB1 to HB7 are defined as $\alpha$1 to $\alpha$7, the temperature coefficient of resistances $\alpha$1 and $\alpha$7 of the heating blocks HB1 and HB7 are set to be higher than the temperature coefficient of resistances $\alpha$2 to $\alpha$6 of the heating block HB2 to HB6. In other words, at normal temperature Tj, the resistance values per unit length of the heating blocks HB2 to HB6 are Rj, which is the same as those of the heating blocks HB1 and HB7, but if the temperature rises to Tm, the resistance value is different for each heating block. In this embodiment, the resistance values per unit length of the heating blocks HB2 to HB6 increase up to R4*m*, and the resistance values of the heating blocks HB1 and HB7 increase up to R1*m* (>R4*m*).

In this way, the temperature coefficient of resistances of the heat generating resistors of the heating blocks of which width in the longitudinal direction (width of the heating region is short) are set in at least one location to be larger than the temperature coefficient of resistances of the heat generating resistors of the heating blocks of which width in the longitudinal direction is long. Here the lengths of the heating blocks HB1 and HB7 are the same, hence $\alpha 1=\alpha 7$. The temperature coefficient of resistances vary, hence in this embodiment, it is assumed that $\alpha 4<\alpha 1$, $\alpha 7$ is always established even if the upper and lower limits of the variation are considered.

In this embodiment, the temperature coefficient of resistance is set higher only in the heating blocks HB1 and HB7, but may also be set higher in the heating blocks HB2, HB3, HB5 and HB6 in accordance with the length, since the lengths of these blocks are also shorter than the heating block HB4.

Figure 6A:
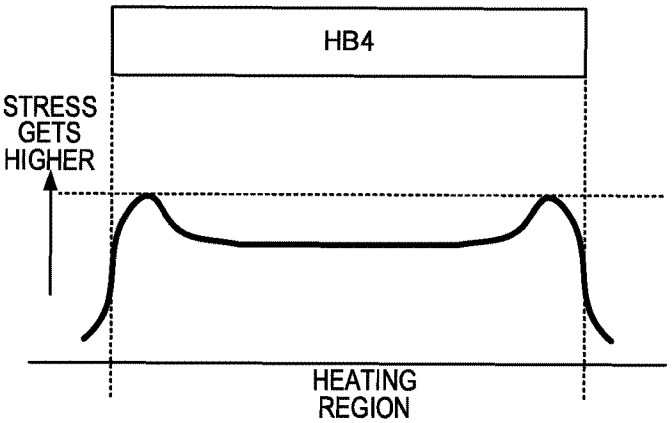
FIG. 6A to FIG. 6D are diagrams depicting a case when the present invention according to Embodiment 1 is not applied.
Figure 6B:
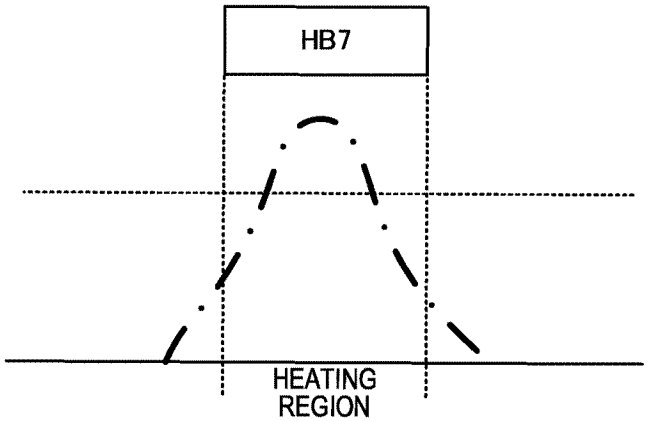
Figure 6C:
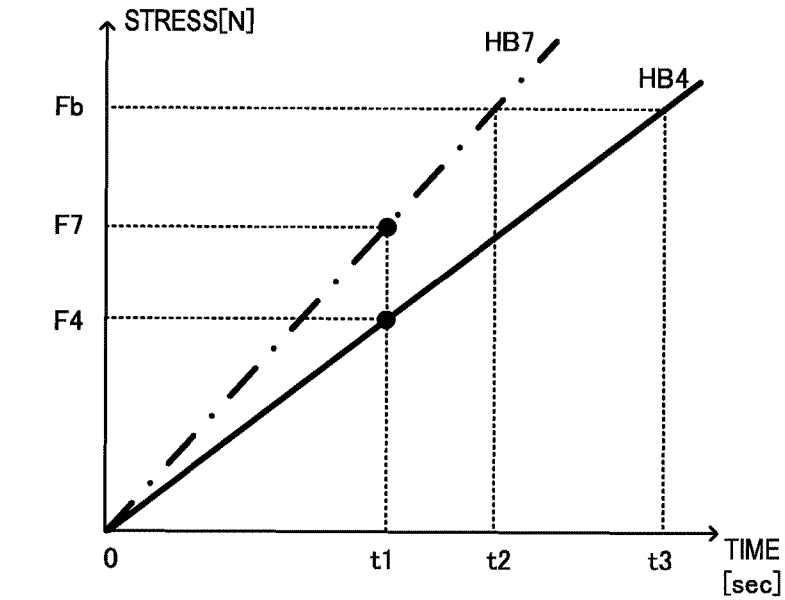

FIG. 6A to FIG. 6D are diagrams depicting thermal stress when an abnormality occurred, in the case where the configuration of the embodiment described in FIG. 5A and FIG. 5B is not used, that is, in the case where the temperature coefficient of resistances of the heating blocks HB1 to HB7 are set to a same value. FIG. 6A indicates the thermal stress distribution when only the temperature of the heating block HB4 excessively rises, and FIG. 6B indicates the thermal stress distribution when only the temperature of heating block HB7 excessively rises. FIG. 6A and FIG. 6B both indicate the thermal stress distributions when a predetermined time t1 elapsed from application of the same voltage to each heating block on the assumption that temperature control is disabled because of a failure of the CPU 403, the drive units 414 and 417, or the like. FIG. 6A and FIG. 6B also indicate the thermal stress distributions along the Y1 line in FIG. 3B. Description on the heating block HB1, that is the same as the heating block HB7, is omitted.

The thermal stress is distorted at a portion where the thermal difference is large, therefore the stress is high on both ends of the heating block in the longitudinal direction. When this stress exceeds the breaking limit of the material constituting the heater 300, the heater 300 breaks down (e.g. the heater cracks). Hence the protective devices 431 to 437 in FIG. 4 monitor the temperature and turn the power to the heater 300 OFF to protect the heater 300 before this breaking point is exceeded.

Figure 6D:
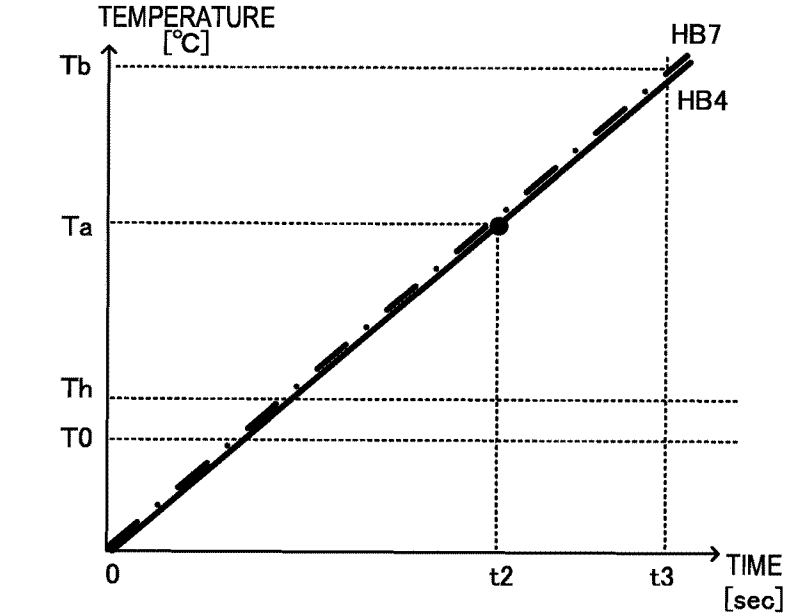

In the case of a heating block that is wide in the longitudinal direction, such as the heating block HB4, the stress portions generated on both ends are far from each other. In the case of a heating block that is narrow, such as the heating block HB7, on the other hand, the stress portions generated on both ends are close to each other and partially overlap, which increases the stress value. In other words, as indicated in the time-stress relationship diagram in FIG. 6C, the thermal stress is higher in HB7 than in HB4 at a predetermined time t1 after the power is turned ON (stress F7>F4). Furthermore, when the stress reaches Fb, the heater 300, constituted of ceramics, breaks down. That is, HB7 reaches breakdown sooner than HB4 (t2<t3). FIG. 6D is a time-heating block temperature relationship diagram, and indicates that the temperatures of the heating blocks are Ta and Tb at the times t2 and t3 when breakdown occurs. TO is a regulated temperature when the image forming apparatus 100 is operating normally, and Th is a threshold of the monitoring temperature of the protective devices 431 to 437 to protect the image forming apparatus 100 when an abnormality occurs during operation. In other words, to prevent the breakdown of the heater 300, the monitoring temperature threshold Th is set to be lower than the temperatures Ta and Tb, at which the heater 300 breaks down by thermal stress.

Figure 7A:
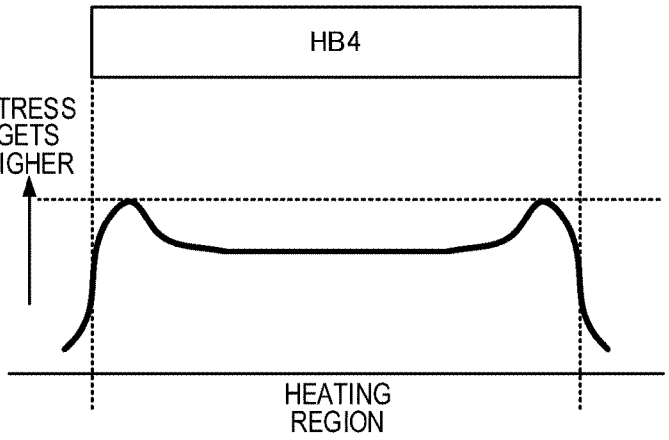
FIG. 7A to FIG. 7D are diagrams depicting the effect of the present invention according to Embodiment 1.
Figure 7B:
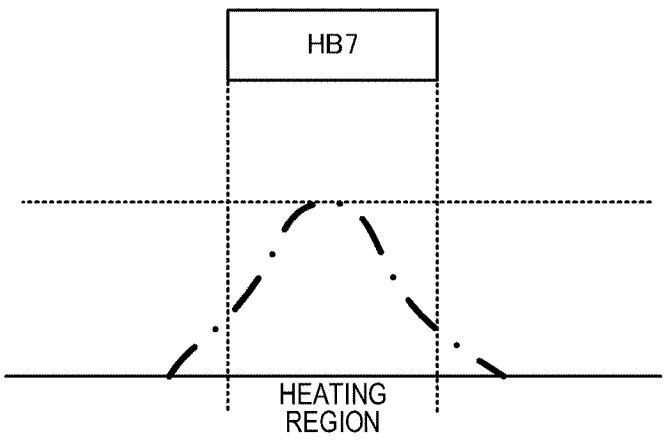
Figure 7C:
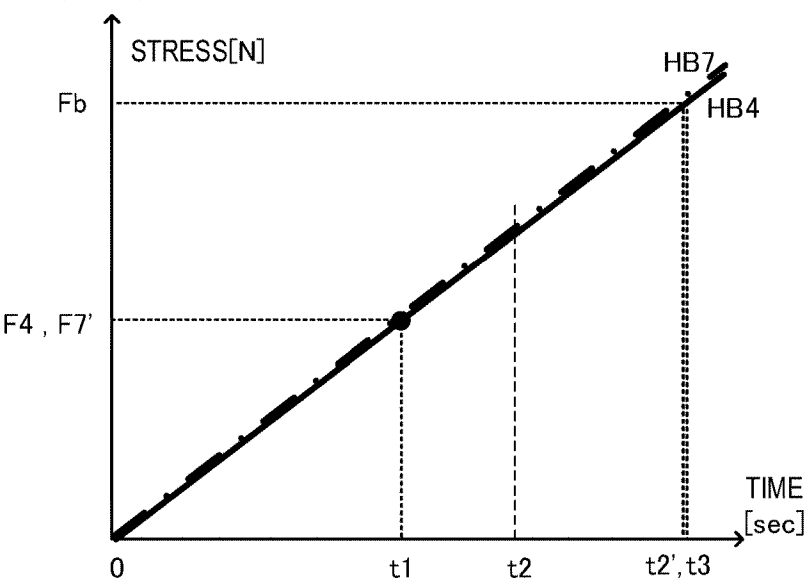
Figure 7D:
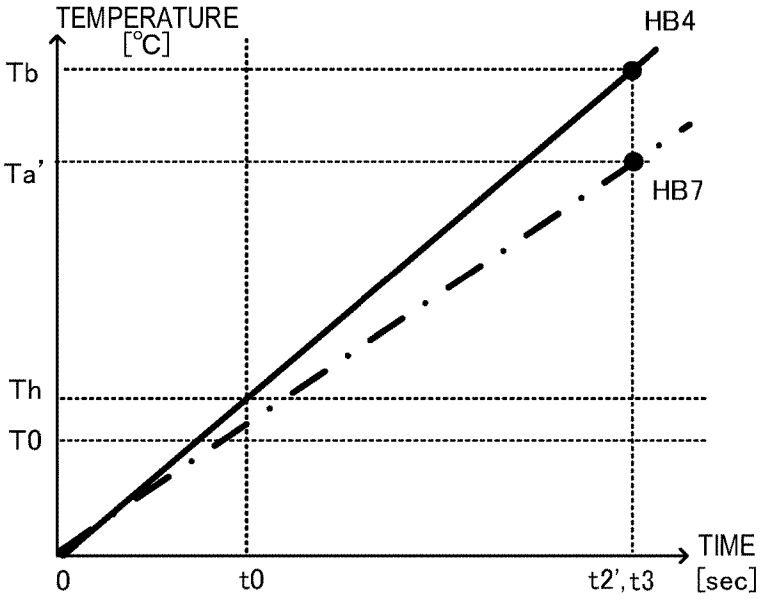

FIG. 7A to FIG. 7D are diagrams depicting the thermal stress during an abnormality, in the case where the configuration of this embodiment to which the present invention is applied, that is, in the case where the temperature coefficient of resistance $\alpha 7$ is set to be higher than $\alpha 4$. Since the temperature coefficient of resistance $\alpha 7$ of the heating block HB7 is made higher, the temperature rising tendency of the heating block HB7, indicated in FIG. 7D, is lower than that of the heating block HB4 and the rise of the thermal stress can be lowered, as indicated in FIG. 7C. In this embodiment, the stress distribution of the heating block HB7 indicated in FIG. 7B is equivalent to the heating block HB4, as indicated in FIG. 7A. Thereby in the heating block HB7, the temperature to reach the stress Fb, which causes the heater 300 to breakdown, can be higher compared with the case of not using the configuration of this embodiment (Ta'>Ta). Therefore, with respect to the times t2' and t3', to reach breakdown, the operation time t0 of the protective circuits 431 to 437 can be decreased considerably.

In FIG. 5B, the temperature coefficient of resistances $\alpha 2$, $\alpha 3$, $\alpha 5$ and $\alpha 6$ of the heating blocks HB2, HB3, HB5 and HB6 are set to be the same value as $\alpha 4$, so that thermal stress portions at both ends do not overlap in the stress distribution diagram, just like the case of the heating block HB4. In other words, in this embodiment, only the shortest heating block is set to a large temperature coefficient of resistance.

In the example described in this embodiment, the heater 300 is constituted of two lines of heating elements (302*a* and 302*b*) in the shorter direction of the heater 300, but the constitution of the heater 300 is not limited to this, and the heater 300 may be constituted of one line or three or more lines of heating elements.

Besides the method of changing the temperature coefficient of resistance depending on the length of the heating block, a method of changing the resistance value per unit length of the heating block is also possible, to acquire an effect equivalent to the effect of this embodiment. In concrete terms, the resistivities of the heating elements may be changed, or the lengths of the heating elements L1 and L2 indicated in FIG. 3B, may be changed.

In this case, however, the resistance values become high, which decreases power that can be supplied to the heater, and as a result, the surface area is restricted (e.g. surface area of the heating element must be increased). Hence in this embodiment, the method of changing the temperature coefficient of resistances is used.

As described above in this embodiment, the temperature coefficient of resistances of the heat generating resistors in each heating block are configured such that the temperature coefficient of resistance of a heat generating resistor in a heating block, that is narrow in the longitudinal direction, is larger than the temperature coefficient of resistance of a heat generating resistor in a heating block, that is wide in the longitudinal direction. Thereby when the temperature excessively rises due to an abnormality, the time to reach the breakdown stress can be increased, compared with a conventional configuration (configuration to which the present invention is not applied), can be sufficiently longer with respect to the operation time of the protective circuit.

Embodiment 2

A configuration of a heater, of which heating elements have negative temperature coefficient of resistances compared with Embodiment 1, will be described. The same composing elements as Embodiment 1 will be denoted with a same reference symbol, and description thereof will be omitted. The matters related to Embodiment 2, which are not described here, are the same as Embodiment 1.

Figure 8A:
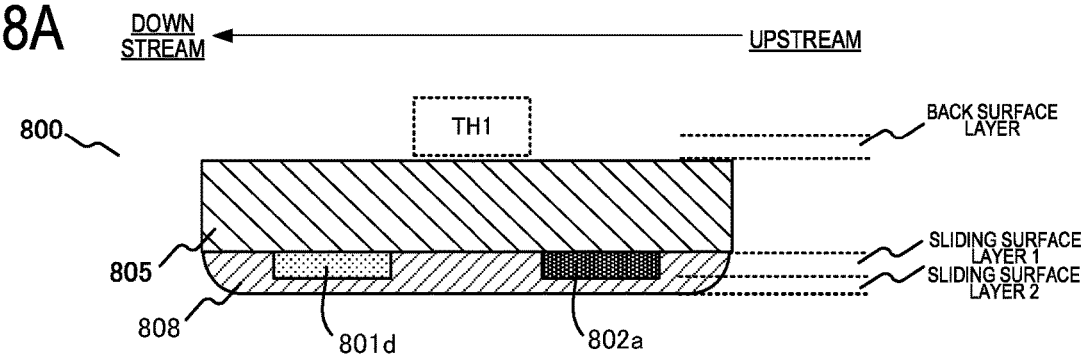
FIG. 8A and FIG. 8B are diagrams depicting a configuration of a heater according to Embodiment 2.
Figure 8B:
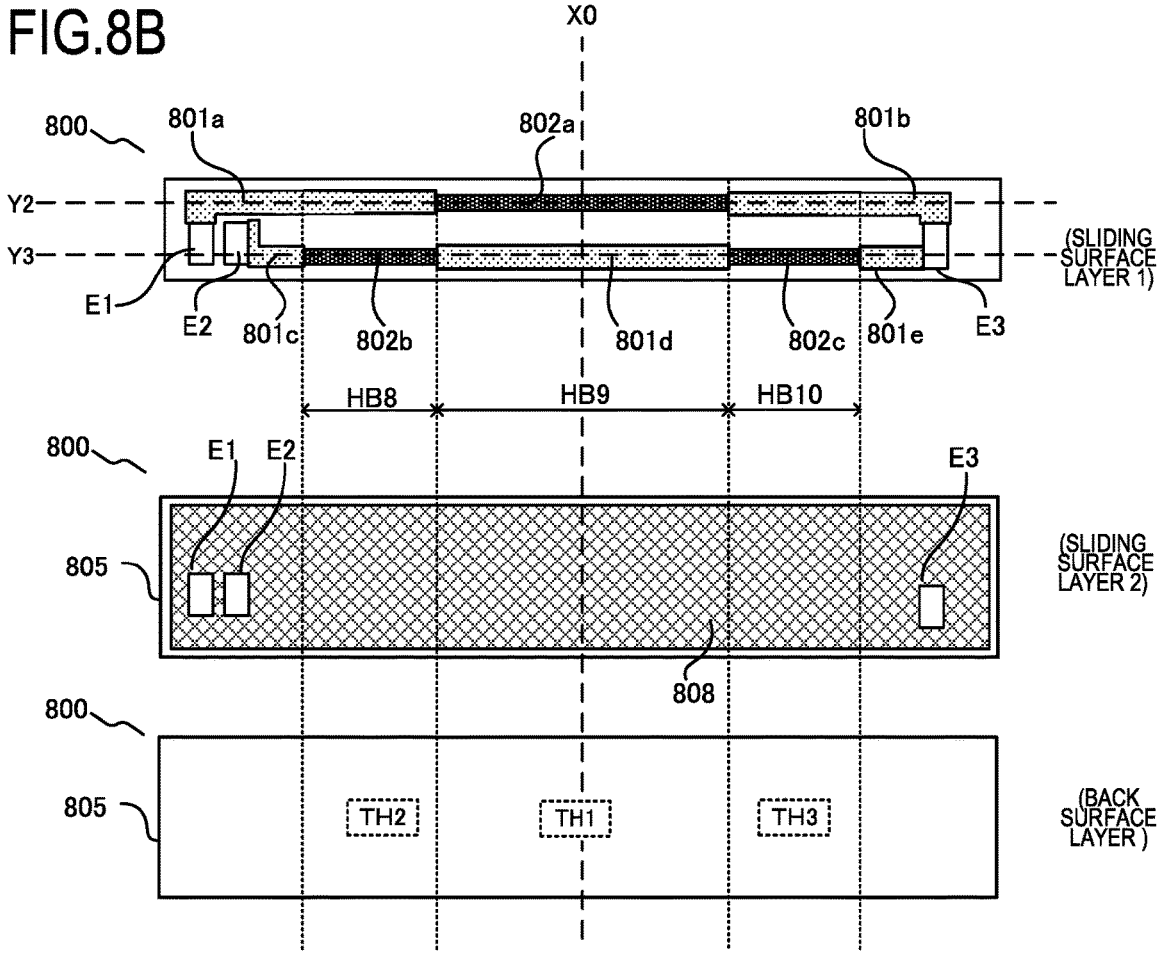

FIG. 8A and FIG. 8B are diagrams depicting a configuration of a heater 800 according to this embodiment. FIG. 8A is a cross-sectional view of the heater 800, and FIG. 8B is a plan view thereof. The cross-sectional view in FIG. 8A is a cross-section of the heater 800 sectioned at the transport reference position X0.

As illustrated in FIG. 8A, the sliding surface layer 1 on a substrate 805 includes a conductor 801*d* and a heating element (heat generating resistor) 802*a*. On the sliding surface layer 2, a protective glass 808 having insulating properties is disposed, so as to cover the sliding surface layer 1, except for electrodes E1 to E3. A thermistor member TH1 is contacted to the back surface layer 1.

As illustrated in FIG. 8B, three sets of heating blocks, constituted of heating elements 802*a*, 802*b* and 802*c*, are disposed on the sliding surface layer 1 of the heater 800 along the longer direction of the heater 800 (HB8 to HB10). The heating element 802*b* and the heating element 802*c* are shorter than the heating element 802*a* in the longitudinal direction. The electrodes E1, E3 and conductors 801*a* and 801*b* constitute a conductive path of the heating element 802*a*. The electrodes E2, E3 and the conductors 801*c* to 801*e* constitute a conductive path of the heating element 802*b* and the heating element 802*c*. The protective glass 808 on the sliding surface layer 2 of the heater 800 is formed such that the heater electrodes E1 to E3 are exposed. Thermistor members TH1 to TH3 are contacted to the back surface layer at the illustrated positions. TH1, TH2 and TH3 are disposed separately at positions to detect the temperatures of the heating blocks HB9, HB8 and HB10 respectively.

Figure 9:
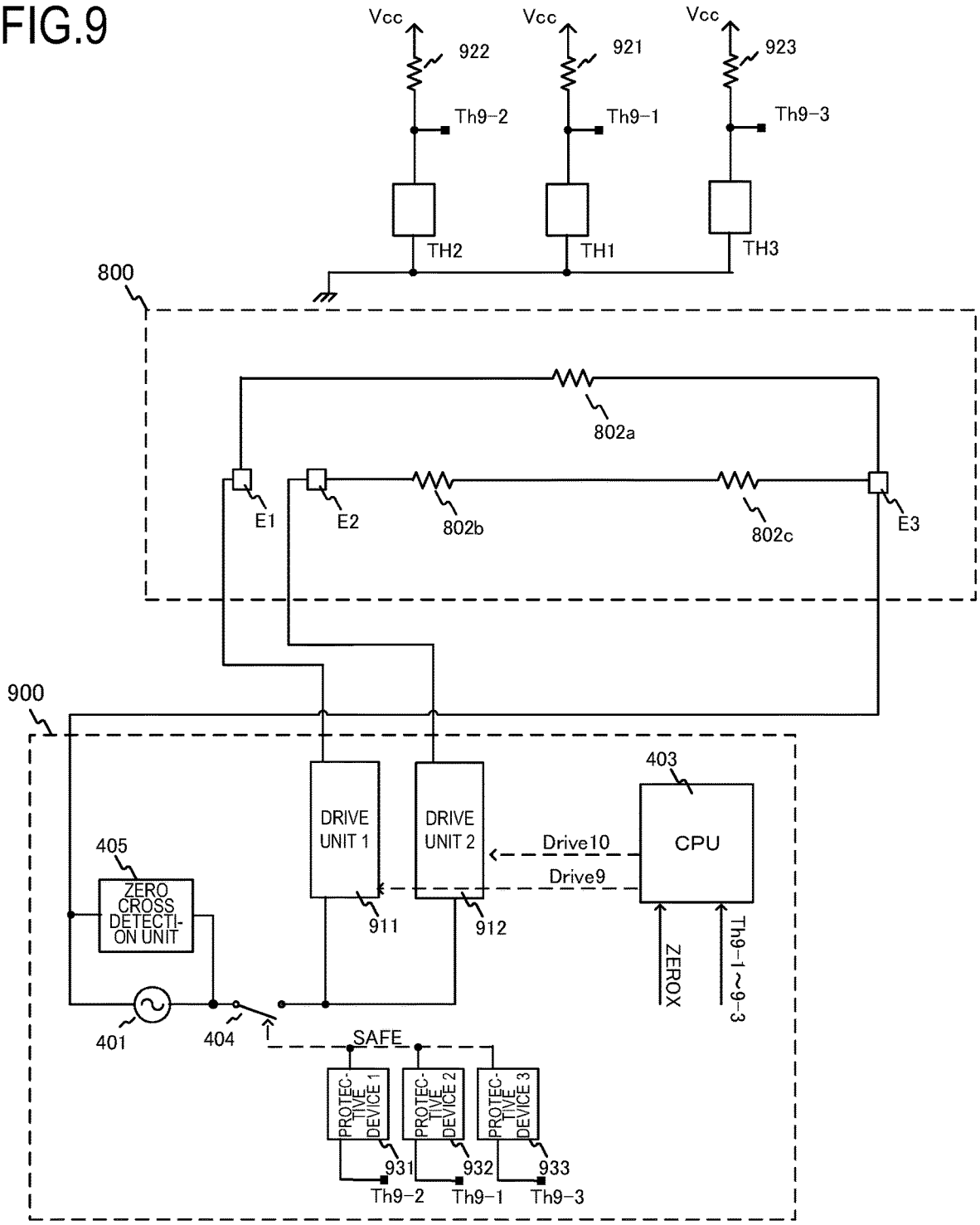
FIG. 9 is a circuit connection diagram according to Embodiment 2.

FIG. 9 is a block diagram depicting a control circuit 900 and an electric connection according to this embodiment. Based on the thermistor signals Th9-1 to Th9-3, which are generated by dividing the voltage in the thermistors TH1 to TH3 and resistors 921 to 923 respectively, a CPU 403 generates drive signals Drive9 and Drive10, and controls drive units 911 and 912. Protective devices 931 to 933 monitor temperatures to protect against reaching an abnormal temperature, based on the thermistor signals Th9-1 to Th9-3. If temperature reaches an abnormal temperature a SAFE signal is activated, and a relay 404 is forcibly set to a non-conducting state, so as to stop feeding power to the heater 800.

Figure 10A:
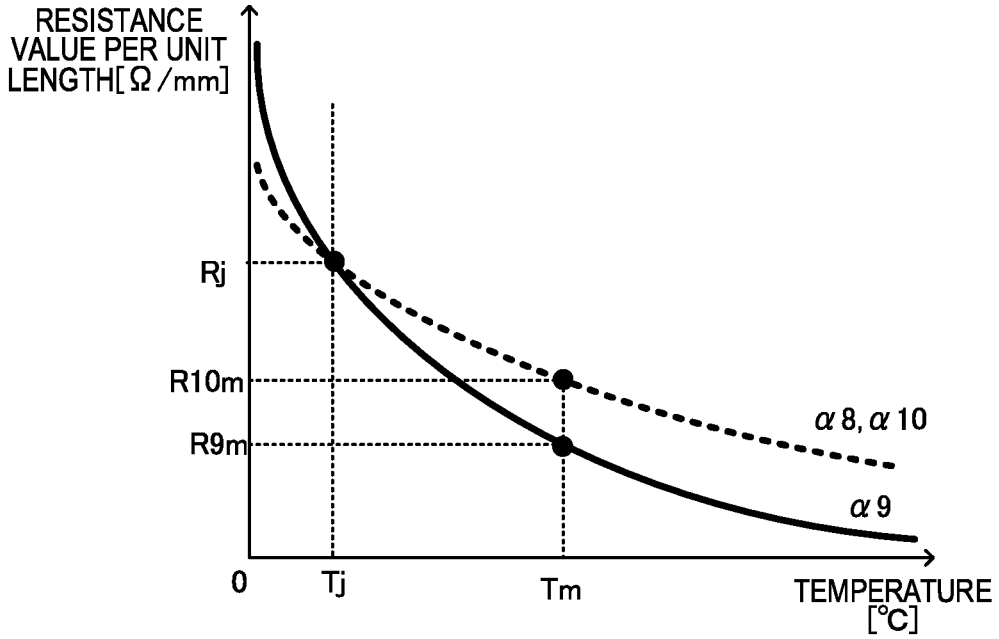
FIG. 10A and FIG. 10B are diagrams depicting the temperature characteristic of the heating elements and distribution of the temperature coefficient of resistances according to Embodiment 2.
Figure 10B:
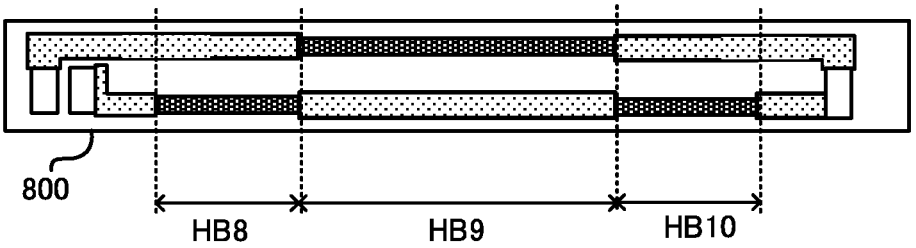

FIG. 10A and FIG. 10B are diagrams depicting the resistance temperature characteristic of the heating elements 802*a* to 802*c* of the heater 800 according to this embodiment. FIG. 10A is a graph depicting the temperature and the resistance value per unit length of the heating element in the length direction, and FIG. 10B indicates the distribution of the resistance temperature characteristic of the heater 800 of this embodiment. The heating elements 802*a* to 802*c* of this embodiment have a negative resistance temperature characteristic, unlike Embodiment 1, hence the resistance values thereof decrease as the temperature rises (from normal temperature Tj to Tm). The temperature coefficient of resistance α, which indicates the inclination, is also determined by the material characteristic of the heating element, just like Embodiment 1. The heater having this negative temperature coefficient of resistance has a heating region that is longer than the width of the recording paper P, and the heat of the non-paper passing portions is not transferred to the recording paper P. Hence when the temperature of the heating elements rises locally (temperature rise in the non-paper passing portion), the temperature rise can be suppressed. Since the resistance value partially drops in the heating element of which temperature is rising, the heating value difference is generated between the paper passing portion and the non-paper passing portion, whereby a temperature rise in the non-paper passing portion is suppressed. In this embodiment, when the temperature coefficient of resistances of the heating blocks HB8 to HB10 are defined as α8 to α10, the temperature coefficient of resistances α8 and α10 of the heating blocks HB8 and HB10 (blocks of which widths are narrow) are set to be higher than the temperature coefficient of resistance α9 of the heating block HB9 (block of which width is wide). In other words, because the negative temperature coefficient of resistances are used, and the absolute value thereof is small. At normal temperature Tj, the resistance values per unit length of the heating block HB8 and HB10 are Rj, which is the same as that of the heating block HB9. If the temperature rises to Tm, however, the resistance value per unit length of the heating block H9 drops to R9*m*, while the resistance values of the heating blocks HB8 and HB10 drops only to R10*m* (>R9*m*).

In this way, the temperature coefficient of resistance of the heat generating resistor of the heating block of which width in the longitudinal direction (heating region width) is narrow is set to be larger than the temperature coefficient of resistance of the heat generating resistor of the heating block of which width in the longitudinal direction is wide.

Figure 11A:
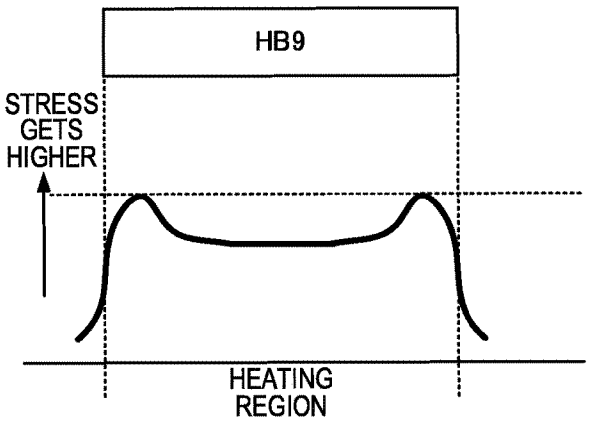
FIG. 11A to FIG. 11D are diagrams depicting a case when the present invention according to Embodiment 2 is not applied.
Figure 11B:
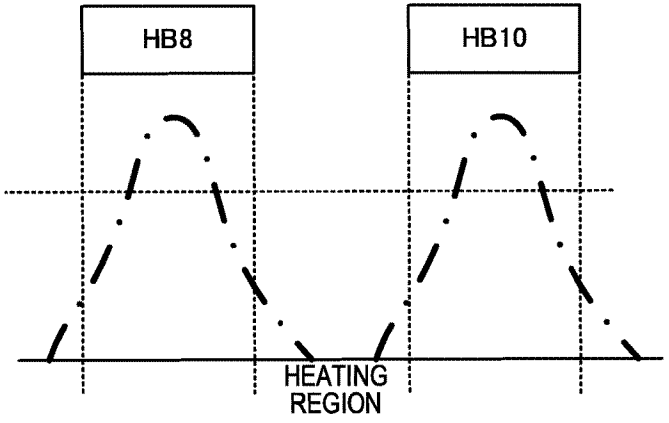

FIG. 11A to FIG. 11D are diagrams depicting a thermal stress when an abnormality occurred, in the case where the configuration of an embodiment of the present invention is not used, that is, in the case where the temperature coefficient of resistances of HB8 to HB10 are set to the same value. FIG. 11A indicates the thermal stress distribution when only the temperature of the heating block HB9 excessively rises, and FIG. 11B indicates the thermal stress distribution when the control system related to the drive unit 912 fails, and the heating blocks HB8 to HB10 excessively rise at the same time. Both cases indicate the thermal stress distribution when the same voltage is applied to each heating block, and a predetermined time t4 elapsed. FIG. 11A and FIG. 11B are the thermal stress distributions along the Y2 and Y3 lines in FIG. 8A and FIG. 8B respectively.

Just like Embodiment 1, the thermal stress is high on both ends of the heating block where a temperature difference is generated, and the heating block HB9 has the distribution indicated in FIG. 11A. In the heating blocks HB8 and HB10, on the other hand, thermal stress is generated individually since the heating regions thereof are distant from each other, and the respective stress value is high because the heating blocks are narrow, and the stress portions overlap.

Figure 11C:
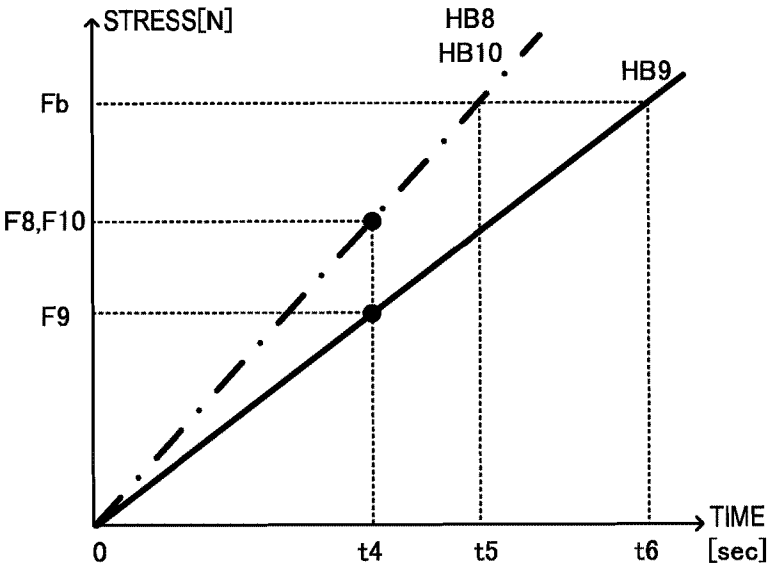
Figure 11D:
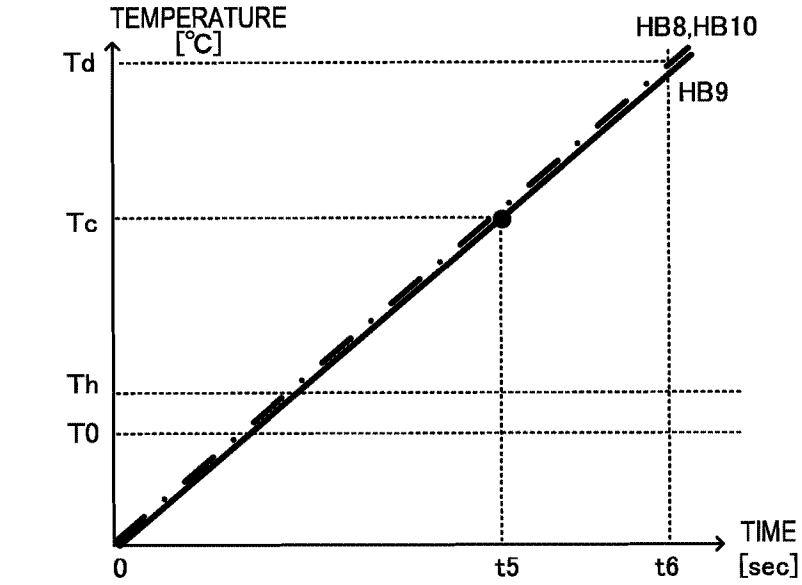

In other words, as indicated in the time-stress relationship diagram in FIG. 11C, the thermal stress is higher in the heating blocks HB8 and HB10 at a predetermined time t4, which elapsed after the power is turned ON (stress F9<stress F8 and F10). Furthermore, when the stress reaches Fb, the heater 800, constituted of ceramics, breaks down. That is, the heating blocks HB8 and HB10 reach a breakdown sooner than the heating block HB9 (t5<t6). FIG. 11D is a time-heating block temperature relationship diagram, and also indicates that the heating blocks HB8 and HB10 breakdown first at temperature Tc, and the temperature Tc is lower than the temperature Td of the heating block HB9. In other words, it is preferable to set the temperature Tc to be higher than the monitoring temperature threshold Th of the protective devices 931 to 933, so as to increase the time t5 to reach breakdown.

Figure 12A:
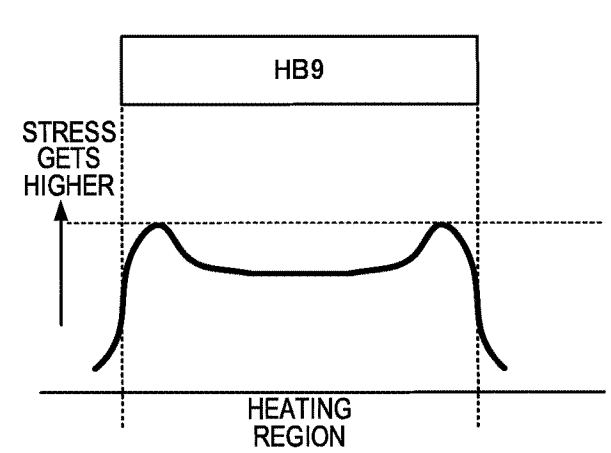
FIG. 12A to FIG. 12D are diagrams depicting the effect of the present invention according to Embodiment 2.
Figure 12B:
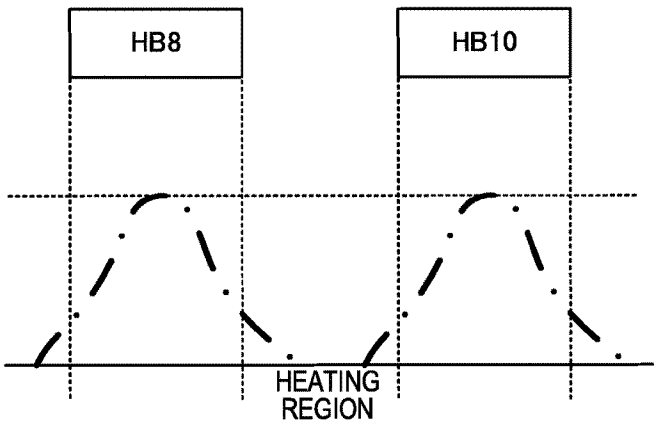
Figure 12C:
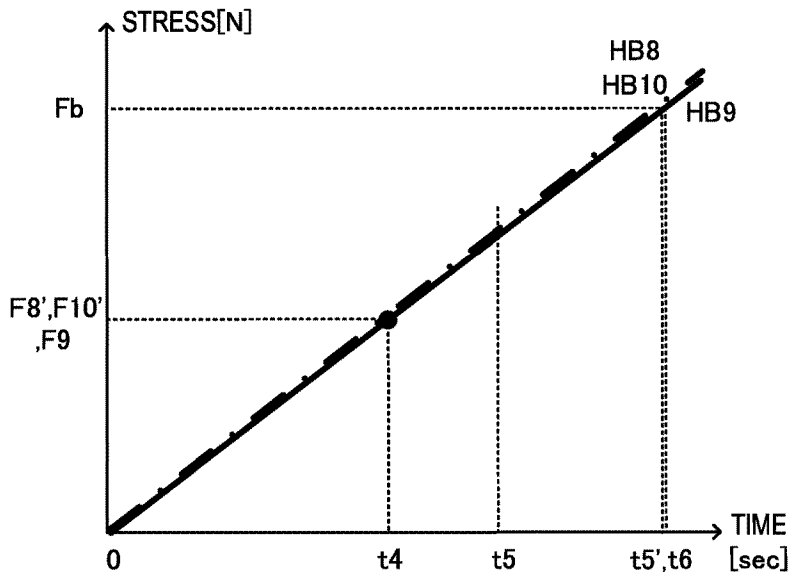
Figure 12D:
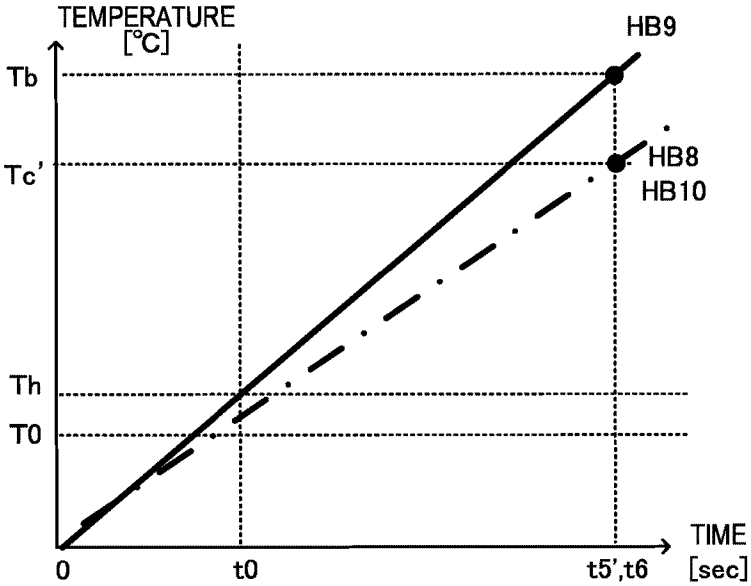

FIG. 12A to FIG. 12D are diagrams depicting the thermal stress when an abnormality occurred, in the case where the configuration of this embodiment of the present invention is applied, that is, in the case where the temperature coefficient of resistances α8 and α10 are set to be higher than a9. Since the temperature rising tendency of the heating blocks HB8 and HB10 indicated in FIG. 12D is lower than that of the heating block HB9, the rise of the thermal stress can be lowered when compared with a same timing, as indicated in FIG. 12C. Thereby the temperature to reach the stress Fb, that causes a breakdown of the heater in the heating blocks HB8 and HB10, can be increased compared with the case of not using the configuration of this embodiment (Tc'>Tc). Therefore, with respect to the time t5' and t6' to reach breakdown, the operation time t0 of the protective circuits 931 to 933 can be sufficiently shorter.

As described above in this embodiment, the heater is configured such that the temperature coefficient of resistance of a heat generating resistor in a heating block that is narrow in the longitudinal direction is larger than the temperature coefficient of resistance of a heat generating resistor in a heating block that is wide in the longitudinal direction, even when the heat generating resistors have negative temperature coefficient of resistances. Thereby when the temperature excessively rises due to abnormality, the time to reach breakdown stress can be increased compared with a conventional configuration (configuration to which the present invention is not applied), and can be sufficiently longer with respect to the operation time of the positive circuit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-237166, filed on Dec. 19, 2018, which is hereby incorporated by reference herein in its entirety.

What is claimed is:

1. An image forming apparatus, comprising:

an image forming portion that forms an image on a recording material;

an image heating portion that includes a heater including a substrate and a plurality of heat generating resistors disposed on the substrate, and heats the image formed on the recording material using heat of the heater; and a control portion that individually controls a plurality of heating regions which are heated by the plurality of heat generating resistors, by individually controlling power to be supplied to the plurality of heat generating resistors, wherein the plurality of heat generating resistors include (i) a first heat generating resistor that has a first temperature coefficient of resistance, and (ii) a second heat generating resistor that has a second temperature coefficient of resistance which is larger than the first temperature coefficient of resistance, and heats a second heating region of which width in the longitudinal direction of the substrate is narrower than a first heating region which is heated by the first heat generating resistor, among the plurality of heating regions.

2. The image forming apparatus according to claim 1, wherein in the plurality of heat generating resistors, the temperature coefficient of resistance of a heat generating resistor is larger as a width in a longitudinal direction of the heating region heated by the heat generating resistor is narrower.

3. The image forming apparatus according to claim 1, wherein the plurality of heat generating resistors are disposed on the substrate in the longitudinal direction.

4. The image forming apparatus according to claim 1, further comprising:

a plurality of temperature detection units that detect temperature of the heater; and a plurality of protective units that stop power supply to the heat generating resistor, wherein each of the plurality of protective units stops power supply to the heat generating resistor when each of the temperatures detected by the plurality of temperature detection units corresponding to the each of the plurality of protective units indicates abnormal temperature.

5. The image forming apparatus according to claim 4, wherein the plurality of temperature detection units detect the temperature of the heater for each of the plurality of heating regions, wherein the control portion controls the power to be supplied to the plurality of heat generating resistors for each of the plurality of heating regions based on the each of the temperature detected by the plurality of temperature detection units.

6. The image forming apparatus according to claim 1, wherein the first heat generating resistor and the second heat generating resistor are configured such that the respective resistivities per unit length in the longitudinal direction are the same at a predetermined temperature.

7. The image forming apparatus according to claim 1, wherein the image heating portion further includes a cylindrical film of which inner surface contacts with the heater.

* * * * *